US008833015B2

(12) United States Patent
Bilge

(10) Patent No.: US 8,833,015 B2
(45) **Date of Patent: *Sep. 16, 2014**

(54) SYSTEM FOR MOUNTING WALL PANELS TO A WALL STRUCTURE

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/747,035

(22) Filed: Jan. 22, 2013

(65) Prior Publication Data

US 2014/0202094 A1 Jul. 24, 2014

(51) Int. Cl.
*E04F 13/07* (2006.01)
*E04B 2/18* (2006.01)
*E04F 13/08* (2006.01)

(52) U.S. Cl.
CPC ..... *E04F 13/0814* (2013.01)
USPC ..... 52/235; 52/506.05

(58) Field of Classification Search
USPC ..... 52/235, 463, 468, 483.1, 489.1, 506.05, 52/506.06, 506.08, 508–512, 656.9
See application file for complete search history.

(56) References Cited

U.S. PATENT DOCUMENTS 1,655,406 A * 1/1928 Bennett ..... 52/365
1,726,500 A * 8/1929 Forbush ..... 52/145
1,833,174 A * 11/1931 Forbush ..... 52/356
2,059,483 A * 11/1936 Parsons ..... 52/506.06
2,066,205 A * 12/1936 Keating ..... 52/506.09
2,082,241 A * 6/1937 Bennett ..... 52/387
2,607,971 A * 8/1952 Bedford, Jr. ..... 52/713
2,789,321 A * 4/1957 Adams ..... 52/145
2,803,321 A * 8/1957 Fox-Williams ..... 52/464
3,021,915 A * 2/1962 Kemp ..... 181/290
3,671,061 A * 6/1972 Dawdy ..... 52/511
3,858,377 A 1/1975 Browne et al.
4,332,119 A * 6/1982 Toews ..... 52/481.2
4,344,267 A 8/1982 Sukolics
4,452,029 A * 6/1984 Sukolics ..... 52/747.1
4,573,300 A * 3/1986 Bezner ..... 52/563
4,640,064 A * 2/1987 Goodworth, II ..... 52/506.08

(Continued)

FOREIGN PATENT DOCUMENTS

DE 3732534 A1 * 4/1989 ..... E04F 13/08
DE 3732535 A1 * 4/1989 ..... E04F 13/08

(Continued)

OTHER PUBLICATIONS

Bamco Inc., G500 Wall System.

*Primary Examiner* — Robert Canfield
*Assistant Examiner* — Charissa Ahmad
(74) *Attorney, Agent, or Firm* — Richard M. Goldberg

(57) ABSTRACT

A system for mounting wall panels to a wall, includes wall panels, each including a main wall panel, and at least two bent end sections with a cut-out section and a wall thickness; and a plurality of main fastening extrusions, each including a base section to be secured to the wall, and two parallel, spaced apart flexible and resilient bent end securing walls extending from the base section, each bent end securing wall including a projection facing the other bent end securing wall, the bent end securing walls spaced apart corresponding to the wall thickness of two bent end sections, such that pressing of the bent end sections into the spacing between the bent end securing walls causes biasing away of the bent end securing walls until the projections engage in respective cut-out sections with the bent end sections being at least in near abutting relation.

12 Claims, 4 Drawing Sheets

(56) References Cited

U.S. PATENT DOCUMENTS

| | | | | |
|---|---|---|---|---|
| 4,667,579 | A * | 5/1987 | Daw | 454/187 |
| 4,696,142 | A | 9/1987 | Mieyal et al. | |
| 4,829,740 | A | 5/1989 | Hutchison | |
| 4,833,839 | A * | 5/1989 | Kurose | 52/39 |
| 4,833,858 | A * | 5/1989 | Hutchison | 52/475.1 |
| 5,263,292 | A * | 11/1993 | Holland et al. | 52/235 |
| 5,579,624 | A * | 12/1996 | Aeberhard | 52/586.2 |
| 5,644,878 | A * | 7/1997 | Wehrmann | 52/287.1 |
| 5,809,729 | A | 9/1998 | Mitchell | |
| 5,996,301 | A * | 12/1999 | Conterno | 52/563 |
| 6,101,777 | A * | 8/2000 | Bodine et al. | 52/506.06 |
| 6,164,024 | A * | 12/2000 | Konstantin | 52/200 |
| 6,205,733 | B1 * | 3/2001 | LaLonde | 52/506.07 |
| 6,330,772 | B1 * | 12/2001 | Mitchell et al. | 52/235 |
| 6,430,885 | B1 * | 8/2002 | Ito | 52/483.1 |
| 6,536,175 | B2 * | 3/2003 | Conterno | 52/489.1 |
| 6,745,527 | B1 * | 6/2004 | Sherman et al. | 52/235 |
| 6,751,916 | B1 * | 6/2004 | Ritzer et al. | 52/385 |
| 6,892,500 | B2 * | 5/2005 | Zaborowski | 52/506.06 |
| 7,210,273 | B2 * | 5/2007 | Zahner, III | 52/302.3 |
| 7,472,521 | B2 | 1/2009 | Bilge | |
| 7,621,084 | B2 | 11/2009 | Bilge | |
| 7,644,547 | B2 * | 1/2010 | Bonshor | 52/209 |
| 7,752,818 | B1 * | 7/2010 | Roegge et al. | 52/235 |
| 8,127,507 | B1 | 3/2012 | Bilge | |
| 8,166,716 | B2 * | 5/2012 | Macdonald et al. | 52/235 |
| 8,225,572 | B2 * | 7/2012 | Wallace | 52/512 |
| 8,256,181 | B2 * | 9/2012 | Voegele et al. | 52/543 |
| 8,307,607 | B2 * | 11/2012 | Conterno | 52/766 |
| 8,316,609 | B2 * | 11/2012 | Ben-Zvi | 52/582.1 |
| 8,347,569 | B1 * | 1/2013 | McIntyre et al. | 52/235 |
| 2001/0022058 | A1 * | 9/2001 | Conterno | 52/489.1 |
| 2002/0035811 | A1 * | 3/2002 | Heuel | 52/506.05 |
| 2002/0152704 | A1 * | 10/2002 | Thompson et al. | 52/506.06 |
| 2003/0192268 | A1 * | 10/2003 | Zaborowski | 52/220.6 |
| 2004/0134143 | A1 * | 7/2004 | Boyer | 52/235 |
| 2005/0102948 | A1 * | 5/2005 | Zahner, III | 52/582.2 |
| 2009/0049770 | A1 | 2/2009 | Konstantin | |
| 2009/0241444 | A1 * | 10/2009 | Griffiths | 52/235 |
| 2009/0241451 | A1 * | 10/2009 | Griffiths | 52/309.4 |
| 2010/0263314 | A1 * | 10/2010 | Macdonald et al. | 52/506.05 |
| 2011/0067338 | A1 * | 3/2011 | Wallace | 52/512 |

FOREIGN PATENT DOCUMENTS

| | | | | |
|---|---|---|---|---|
| EP | 2166169 | A1 * | 3/2010 | E04B 2/74 |
| GB | 2135355 | A * | 8/1984 | E04D 3/362 |
| JP | 08189176 | A * | 7/1996 | E04F 19/02 |

* cited by examiner

SYSTEM FOR MOUNTING WALL PANELS TO A WALL STRUCTURE

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes some of these problems is sold by Bamco Inc. of 30 Baekeland Ave., Middlesex, N.J. 08846 under the designation "G500 WALL SYSTEM." With this system, the wall panels are provided with right angle or bends at their edges. Each planar panel and the right angle bend together form an L-shape. Each bend is secured by screws to a fastening extrusion having the same linear dimension as the wall panel, and the fastening extrusion has a generally rectangular cross-sectional configuration. At each joint area where two panels meet, there are two such fastening extrusions connected together, each secured to a respective wall panel, with an elongated hard silicone gasket between the fastening extrusions. The fastening extrusions are arranged one above the other at each joint area. Thus, the screws are not visible, thereby eliminating the unsightly appearance of previous system.

However, because of the L-shape at the bends at the edges of the wall panels, it is necessary to separately secure each bend to a fastening extrusion by screws, in addition to securing the fastening extrusions to the wall structure by screws, further increasing the work required to assemble the wall panels. Also, because the bends in the wall panels extend only in a direction perpendicular to the wall panels, the only structural support is provided by the screws which secure each bend to a fastening extrusion. As a result, it is possible to loosen and/or pull out the wall panels.

In addition, in order to secure the fastening extrusions to existing wall structures, one of the connected pair of fastening extrusions is provided with an extension which is separately secured to the existing wall structure. This means that the main bodies of the fastening extrusions are spaced away from the existing wall structure, thereby providing a further weak link in the structure, besides making it more difficult to assemble.

U.S. Pat. Nos. 7,472,521 and 7,621,084, by the same inventor herein disclose systems for mounting wall panels to an existing wall structure, which includes a plurality of wall panels. There are also a plurality of fastening extrusions. Each fastening extrusion includes a securing section for securing the fastening extrusion to the existing wall structure, and a retaining wall structure at one end of the securing section, the retaining wall structure including a recess which receives one hook wall of the wall panel.

The main panel section has a rectangular configuration with four hook walls, and there are four fastening extrusions, with the recess of the retaining wall of each fastening extrusion receiving one hook wall of the wall panel. Each U-shaped cross-sectional profile defines a recess therein, and each fastening extrusion includes at least one stabilizing wall extending from a free end of a respective retaining wall, with the stabilizing wall being received in one recess of a respective U-shaped cross-sectional profile. Each stabilizing wall has an L-shaped cross-sectional profile. Also, the securing section and the retaining wall structure together define a U-shaped cross-sectional profile.

A first one of the fastening extrusions includes a tongue and a second one of the fastening extrusions includes a groove for receiving the tongue to connect together the first and second fastening extrusions when the first fastening extrusion is assembled with a first wall panel and the second fastening extrusion is assembled with a second wall panel. In a later embodiment, there is only a single fastening extrusion.

There is also at least one channel secured to the securing sections of adjacent fastening extrusions and positioned between adjacent wall panels corresponding thereto. An elongated plug is inserted into each channel for closing off the gap between adjacent wall panels.

This arrangement, however, requires the insertion of screws into the fastening extrusions and the channel while supporting the wall panels, which can be burdensome. It also requires the separate channels and plugs in order to close off the gap between adjacent wall panels to provide an aesthetic appearance between the wall panels. If the gap between adjacent panels is varied, this would also require a plurality of different size plugs, which can further add to the cost of the structure.

A further system has been sold for more than one year by Creative Metal Contractors Inca of Toms River, N.J., which uses a single fastening extrusion having tongues extending from opposite sides thereof. The single fastening extrusion is secured to the existing wall by screws at a central portion thereof between the tongues. Each wall panel has a main panel section and hook walls at edges of the main panel section, with the main panel section and each hook wall having a U-shaped cross-sectional profile. Fasteners or frame extrusions are secured to the hook walls, with each fastener including walls defining a recess which receives a corresponding tongue of the single fastening extrusion, such that the tongues are spaced away from the hook walls. A compressed joint plug is positioned in overlying relation to the screws and between adjacent hook walls to provide an aesthetic appearance.

However, with this latter arrangement, plugs are also required, with the same consequent disadvantages. It may also be difficult to align the recesses over the tongues of the single fastening extrusion. In addition, the single fastening extrusions are secured to the existing wall by screws only through the center of the fastening extrusions, which can result in failure of such securement. Still further, if the gap between adjacent panels is varied, this would also require a plurality of different size plugs, which can further add to the cost of the structure.

In addition, in the latter arrangement, the gap between adjacent wall panels is sealed with a silicone sealant and a compressed joint plug. As a result, the air pressure behind the wall panels varies relative to the ambient air pressure in front of the panels. However, architectural requirements require the air pressures to be the same or equalized so as not to reduce the longevity of the wall structure of the building.

The invention of U.S. Pat. No. 8,127,507 to the same inventor herein also requires the insertion of screws into the fastening extrusions and the channel while supporting the wall panels, which can be burdensome. It also requires the separate decorated panels in order to close off the gap between adjacent wall panels to provide an aesthetic appearance between the wall panels.

U.S. patent application Ser. No. 12/652,879, to the same inventor herein, attempts to cure the aforementioned problems, by providing a wall system which does not require the use of screws to secure the wall panels to the fastening extrusions. Rather, the wall panels have recesses into which the frame extrusions fit, and which also eliminates the use of plugs to cover the gap between adjacent wall panels. This permits easy hanging of the wall panels by providing a male connecting frame extrusion that merely fits within a female connecting wall panel.

It is also known from U.S. Pat. No. 4,344,267 to Sukolics, U.S. Pat. No. 4,829,740 to Hutchison and U.S. Pat. No. 5,809,729 to Mitchell, to provide a wall system with L-shaped ends of the panels that include recesses in the bent ends that engage with projections of the extrusions secured by screws to the walls. However, with these patents, there is still a large gap between adjacent bent ends, which is necessary for securing the panels to the extrusions, and which also thereby requires a plug to close this gap.

SUMMARY OF THE INVENTION

Accordingly, it is an object of the present invention to provide a wall system that overcomes the aforementioned problems.

It is another object of the present invention to provide a wall system which does not require the use of screws to secure the wall panels to the fastening extrusions.

It is still another object of the present invention to provide a wall system in which the wall panels are merely pressed into place and retained therein by spring-like extrusions secured to the walls.

It is yet another object of the present invention to provide a wall system that is easy to assemble with an existing wall structure.

It is a further object of the present invention to provide a wall system that eliminates the use of plugs to cover the gap between adjacent wall panels.

It is a further object of the present invention to provide a wall system that is easy and economical to manufacture and use.

In accordance with an aspect of the present invention, a system for mounting wall panels to an existing wall structure, includes a plurality of wall panels, each wall panel including a main wall panel, and at least two bent end sections extending at an angle from different edges of the main wall panel. Each bent end section includes a cut-out section at an inner wall surface thereof, and each bent end section has a wall thickness. A plurality of main fastening extrusions are provided. Each fastening extrusion includes a base section adapted to be secured to the existing wall structure; and two parallel, spaced apart flexible and resilient bent end securing walls extending at an angle from the base section. Each bent end securing wall includes a projection at one surface thereof facing the other bent end securing wall, the two bent end securing walls having a spacing corresponding substantially to the wall thickness of two bent end sections. With this arrangement, pressing of the bent end sections into the spacing between the bent end securing walls causes the bent end securing walls to be biased away from each other until the projections engage in respective cut-out sections to lock the bent end sections in the spacing in a manner that outer walls of the bent end sections are at least in near abutting relation with each other.

The base section includes at least one base securing wall adapted to be secured by fastening devices to the existing wall structure. More preferably, the base section includes a central base securing wall positioned between the bent end securing walls and at least one wing wall coplanar with the central base securing wall and extending outwardly of at least one bent end securing wall, with openings in at least one of the central base securing wall and the at least one wing wall for insertion of the fastening devices therein.

Each cut-out section has a holding surface, and each projection has a corresponding holding surface which is engaged by the holding surface of the respective cut-out section when the projection is engaged in the respective cut-out to prevent escape of the respective bent end section. Preferably, each projection has an inclined surface which terminates in the holding surface thereof, and each cut-out has an inclined surface which terminates in the holding surface thereof.

Further, each projection has an inclined surface which terminates in the holding surface thereof, and each bent end section has a lower end with a beveled surface for engaging with the inclined surface of the respective projection when the bent end section is pressed into the spacing between the bent end securing walls to cause the respective bent end securing wall to be biased away from the other bent end securing wall until the projection engages in the respective cut-out section.

In addition, there are a plurality of corner fastening extrusions. Each corner fastening extrusion includes a corner base section adapted to be secured to one corner wall of the existing wall structure; and a flexible and resilient corner bent end securing wall extending at an angle from the base section. Each corner bent end securing wall includes a projection at one surface thereof facing another adjacent corner wall of the existing wall structure when the base section is secured to the one corner wall. The corner base section has dimensions to space the flexible and resilient corner bent end securing wall from the adjacent corner wall with a spacing corresponding substantially to the wall thickness of one bent end section. As a result, pressing of a the bent end section into the spacing between the corner bent end securing wall and the adjacent corner wall causes the corner bent end securing wall to be biased away from the adjacent corner wall until the projection engages in a respective cut-out section to lock the bent end section in the spacing in a manner that an outer wall of the bent end section is least in near abutting relation with the adjacent corner wall.

The corner base section includes at least one base securing wall adapted to be secured by fastening devices to the existing wall structure. More preferably, the corner base section includes a base securing wall for spacing the bent end securing wall from the adjacent corner wall and a wing wall coplanar with the base securing wall and extending outwardly of the bent end securing wall, with openings in the wing wall for insertion of the fastening devices therein.

Each cut-out section has a holding surface, and the projection of each corner fastening extrusion has a corresponding holding surface which is engaged by the holding surface of the respective cut-out section when the projection is engaged in the respective cut-out to prevent escape of the respective bent end section.

The projection of each corner fastening extrusion has an inclined surface which terminates in the holding surface thereof, and each cut-out has an inclined surface which terminates in the holding surface thereof.

The projection of each corner fastening extrusion has an inclined surface which terminates in the holding surface thereof, and each bent end section has a lower end with a beveled surface for engaging with the inclined surface of the projection of the respective corner fastening extrusion when the bent end section is pressed into the spacing between the corner bent end securing wall and the adjacent corner wall to cause the respective bent end securing wall to be biased away from the adjacent corner wall until the projection engages in the respective cut-out section.

The above and other features of the invention will become readily apparent from the following detailed description thereof which is to be read in connection with the accompanying drawings.

DETAILED DESCRIPTION

Figure 1:
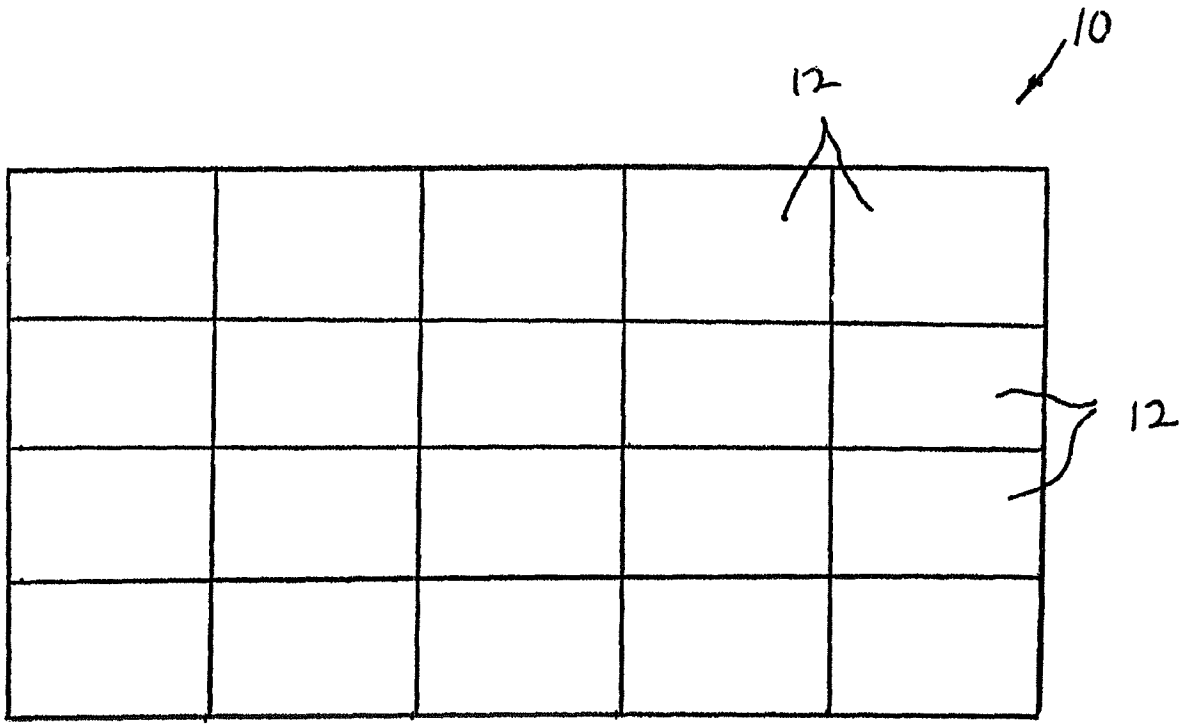
FIG. 1 is an elevational view of a plurality of wall panels mounted to an existing wall structure.

Referring to the drawings in detail, there is shown a system 10 according to the present invention for easily mounting wall panels 12 over an existing wall structure 14. Wall structure 14 preferably includes any planar wall. Each panel 12 includes a rectangular shaped, planar main panel section 16 and at least two bent end sections 18 bent at a right angle in the same direction at edges of main panel section 16. Main panel 16, however, need not be planar, and in fact, can have different shapes, such as a wave shape, etc. to provide different aesthetic appearances. Preferably, there are four bent end sections 18 at each edge of main panel section 16 which form an L-shaped cross-sectional shape thereat. However, the invention is not limited thereby and wall panels 12 can be formed with two, three or four bent end sections 18. Wall panels 12 are formed preferably by, but not limited to, a polyethylene core 20 with a thin aluminum wall 22 covering opposite sides thereof, as shown in FIG. 5. However, for the sake of simplicity in the drawings, FIGS. 3 and 4 show wall panels 12 formed of only a single material.

Figure 2:
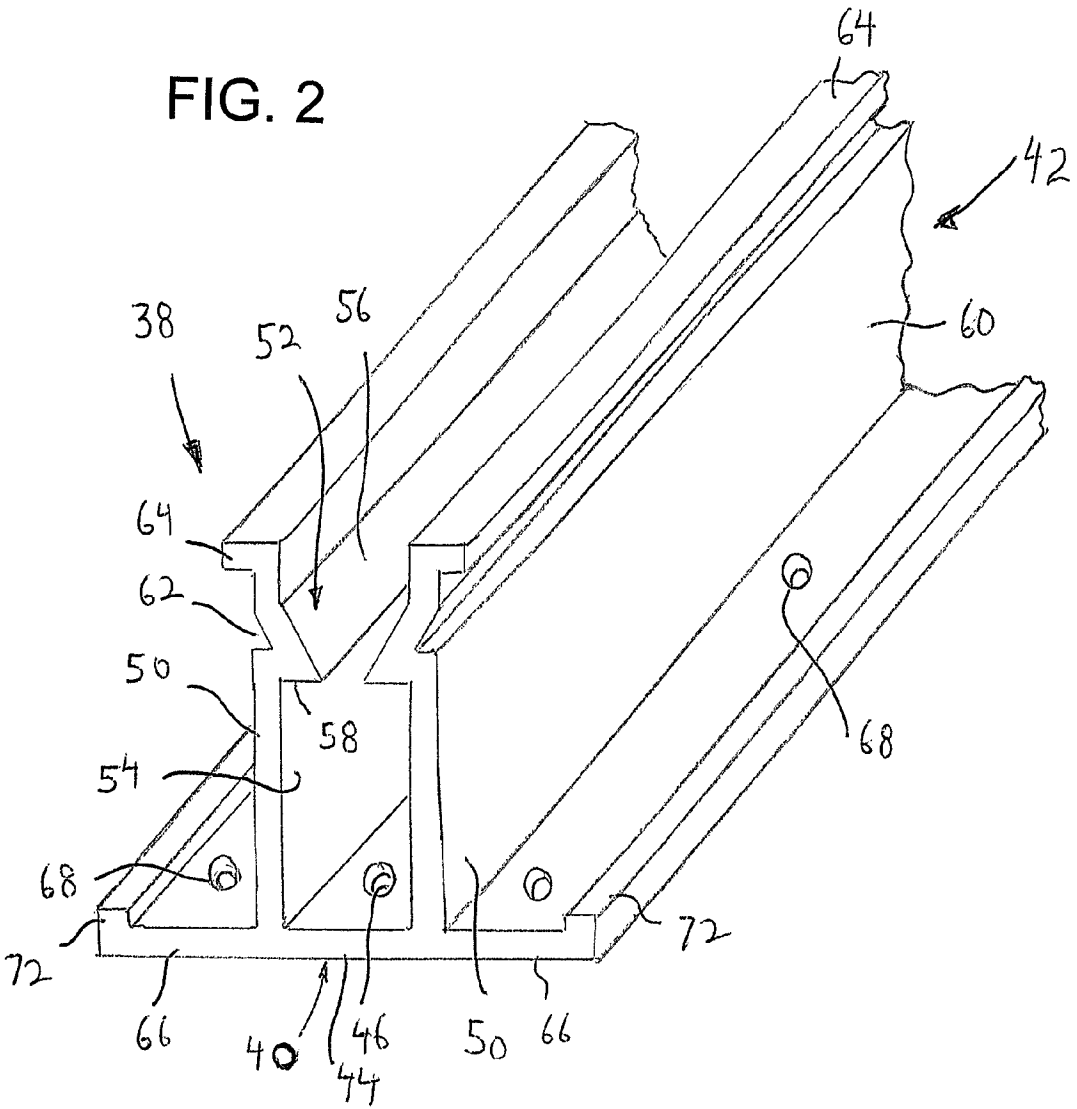
FIG. 2 is a perspective view of a frame extrusion according to the present invention.
Figure 4:
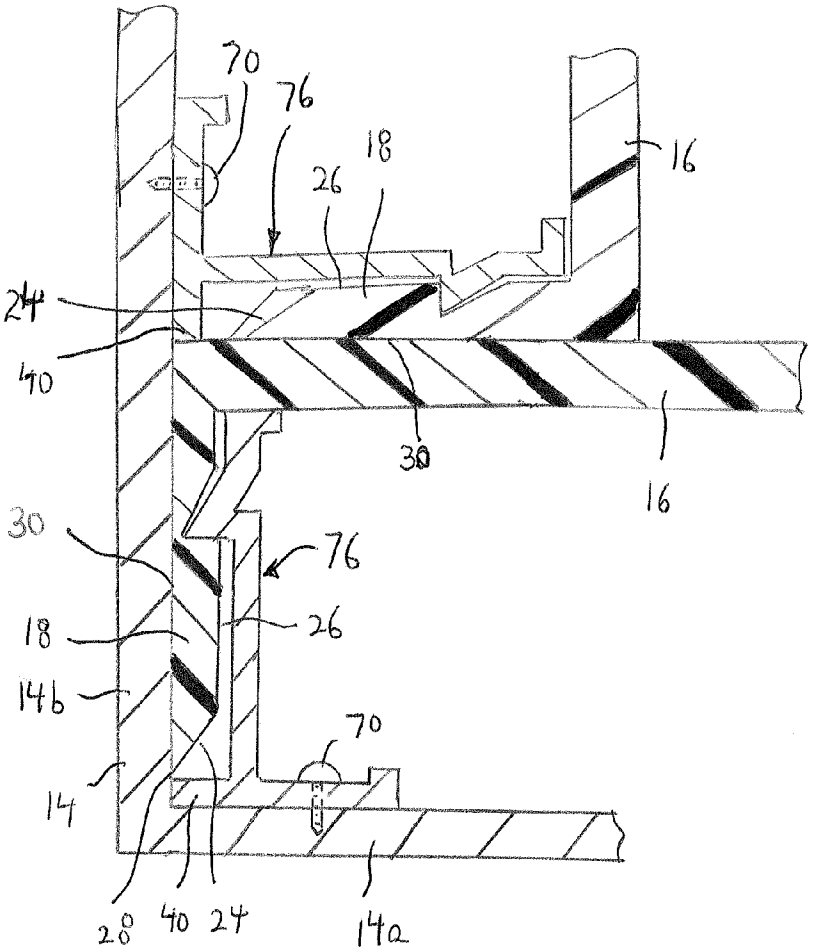
FIG. 4 is a cross-sectional view showing two wall panels connected together by a corner frame extrusion.
Figure 5:
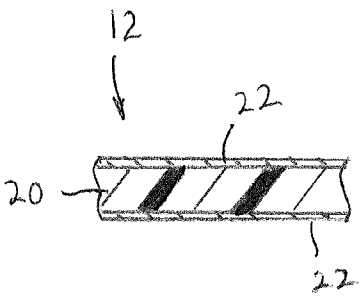
FIG. 5 is a cross-sectional view of a wall panel.

As shown in FIGS. 2 and 4, each bent end section 18 is formed with a lower beveled or inclined surface 24 at the inner surface 26 thereof and extending to a line edge 28 at the distal end of the bent end section 18 at the outer surface 30 thereof. As a result, there is a reduction in thickness of the bent end section 18 at the lower end thereof. Lower beveled surface 24 preferably extends along the entire length of the bent end section 18, although the present invention is not so limited, that is, lower beveled surface 24 can extend along only a part of the length of bent end section 18.

In addition, each bent end section 18 includes a cut-out section 32 at the inner surface 26 thereof and spaced slightly away from main panel section 16. Each cut-out section 32 preferably has a nose-shaped configuration in cross-section, although the present invention is not limited thereby. Specifically, each cut-out section 32 has an inclined surface 34 that extends toward the distal end of the bent end section 18 at the outer surface 30 thereof, and terminates at a holding surface 36 that extends parallel to main panel section 16. As a result, cut-out section 32 effectively forms a notch in the inner surface of bent end section 18. Cut-out section 32 preferably extends along the entire length of the bent end section 18, although the present invention is not so limited, that is, cut-out section 32 can extend along only a part of the length of bent end section 18, or there may be a plurality of spaced apart cut-out sections 32.

Figure 3:
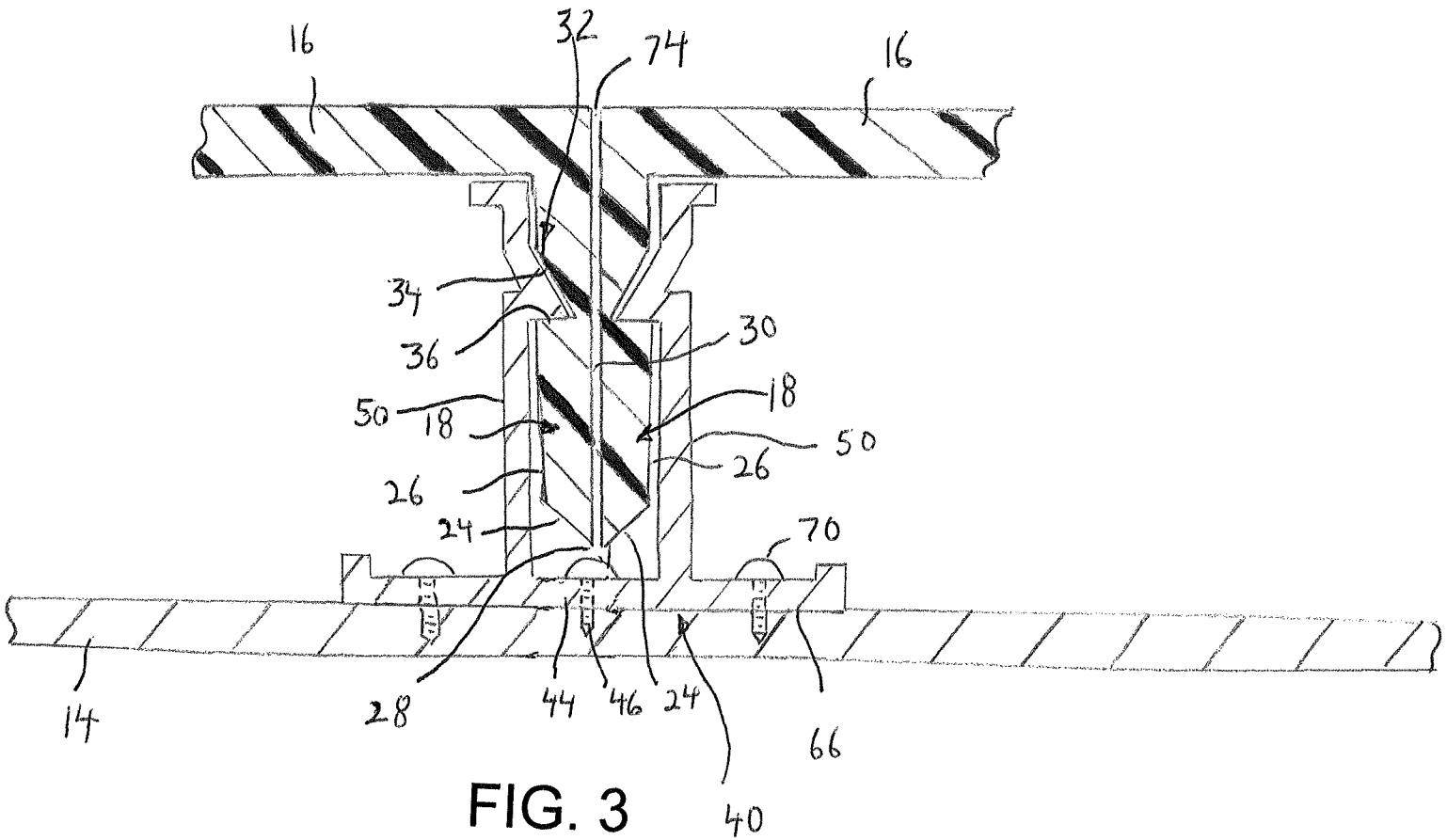
FIG. 3 is a cross-sectional view showing two wall panels connected together by the frame extrusion of FIG. 2.

As shown in FIGS. 2 and 3, main fastening extrusions 38 are provided for securing each wall panel 12 to existing wall structure 14. Each main fastening extrusion 38 is preferably formed as a single, one-piece, unitary member that includes a base section 40 secured to existing wall structure 14 and a supporting section 42 that connects to a side edge of each panel 12. As with each panel 12, each main fastening extrusion 32 is formed preferably by, but not limited to, a polyethylene core 28 with a thin aluminum wall 30 covering opposite sides thereof. However, for the sake of simplicity in the drawings, FIGS. 2 and 4 show main fastening extrusions 38 formed of only a single material.

Base section 40 includes a central planar wall 44 that seats flush against existing wall structure 14, and which has a plurality of linearly aligned openings 46 extending therealong and through which screws 48 can be inserted to secure central wall panel 44 to existing wall structure 14. Two, parallel, spaced apart, bent end securing walls 50 extend outwardly at right angles from opposite ends of central planar wall 44 for securing bent end sections 18 of two adjacent wall panels 12 thereto. As will be understood from the discussion hereafter, bent end securing walls 50 are flexible and resilient, so that they can be bent away from each other and when the bending force is removed, return to their original positions shown in FIGS. 2 and 3.

Each bent end securing wall 50 includes an inwardly directed projection 52 at the inner surface 54 of the respective bent end securing wall 50, with each projection having a nose-shaped configuration in cross-section, which corresponds in shape and dimensions to nose-shaped cut-out section 32, although the present invention is not limited thereby. Specifically, each projection 52 has an inclined surface 56 that slopes in a direction toward base section 40 and terminates at a holding surface 58 that extends parallel to central planar wall 44. Projection 52 preferably extends along the entire length of the bent end securing wall 50, although the present invention is not so limited, that is, projection 52 can extend along only a part of the length of bent end securing wall 50, or there may be a plurality of spaced apart projections 52.

As shown in FIGS. 2 and 3, the outer surface 60 of each bent end securing wall 50 includes a nose-shaped cut-out section 62 corresponding in position to nose-shaped projection 52, in order to save material, although the present invention is not limited thereby, and nose-shaped cut-out section 62 can be eliminated.

The upper free end of each bent end securing wall 50 includes an outwardly extending stub wall 64 that is perpendicular to the respective bent end securing wall 50 and parallel to central planar wall 44.

In addition, although not essential to the present invention, two outwardly extending wing walls 66 extend outwardly from opposite ends of central planar wall 44, that is, outwardly and extending from opposite sides of the lower ends of bent end securing walls 50. Each wing wall 66 is coplanar with central planar wall 44 so as to lie flush against existing wall structure 14, and each wing wall 66 includes a plurality of linearly aligned openings 68 extending therealong and through which screws 70 can be inserted to secure central wall panel wing walls 66 to existing wall structure 14. This provides additional securement of main fastening extrusions 38 to existing wall structure 14. Each wing wall 66 terminates in a bent end stub wall 72, although the present invention is not limited thereby.

With this arrangement, main extrusions 32 are secured to existing wall structure 14 by screws 46 and 70 at predetermined spacing intervals determined by the dimensions of wall panels 12. Thereafter, it is only necessary to push bent end sections 18 of wall panels 12 into the gap between spaced apart bent end securing walls 50. This can be performed with bent end section 18 of one wall panel 12, followed by a bent end section 18 of an adjacent wall panel 12, or with the two bent ends sections 18 of adjacent wall panels 12 simultaneously. In such case, lower beveled surface 24 of each bent end securing wall 50 first hits against inclined surface 56 and biases the respective bent end securing wall 50 outwardly away from the other bent end securing wall 50, whereby the distal end of each bent end section 18 can pass into the space between central planar wall 44 and inwardly directed projection 52. Once holding surface 36 passes holding surface 58, the respective bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel sections 16.

An important aspect of the present invention is that the outer surfaces 30 of adjacent bent end sections 18 are in abutting or near abutting relation, that is, they are at least in near abutting relation. As shown in FIG. 3, there is only a very small gap between adjacent outer surfaces so that they are in near abutting relation, but in fact, they can be, and preferably are, in abutting or touching relation with each other. In other words, the gap 74 between the adjacent outer surfaces 30 is so small that it does not permit bent end sections to be pulled out. With this arrangement, there is no need to provide any sealants or plugs in gap 74, and in fact, no such sealants or plugs would even fit within gap 74.

In other words, the two bent end securing walls 50 have a spacing therebetween corresponding substantially to the wall thickness of the two bent end sections 18 held therein.

In this regard, it is very easy to assemble wall panels 12 by merely pressing bent end sections 18 into the space between adjacent bent end securing walls 50.

As shown in FIG. 4, at a corner of existing wall structure 14, corner fastening extrusions 76 are provided, which merely constitute one-half of a main fastening extrusion 38. Thus, each corner fastening extrusion 76 includes one-half of base section 40, and one wing wall 66 having openings 68, and with only one bent end securing wall 50 having an inwardly directed nose-shaped projection 52 formed by inclined surface 56 at the inner surface 54 thereof and terminating in holding surface 58, along with outwardly extending stub wall 64 at the free end thereof.

During assembly at each corner, a first corner fastening extrusion 76 is secured to one wall 14*a* of existing wall structure 14 by screws 70 extending through openings 68 of the wing 66, such that the free end of base section 40 is in abutting relation to the other wall 14*b* of the corner which is perpendicular to wall 14*a*. In this arrangement, there is a space between the bent end securing wall 50 thereof and the parallel other wall 14*b*. A bent end section 18 is then press fit into this space, whereby the bent end securing wall 50 is biased away from the other wall 14*b*, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16.

In this position, the outer surface 30 of the bent end section 18 is in abutting or near abutting relation with the adjacent corner wall 14*b*, that is, it is at least in near abutting relation.

Then, a second corner fastening extrusion 76 is secured to the other wall 14*b* of existing wall structure 14 by screws 70 extending through openings 68 of the wing 66, such that the free end of base section 40 is in abutting relation to planar main panel section 16 of the already assembled wall panel 12. In this arrangement, there is a space between the bent end securing wall 50 thereof and planar main panel section 16 of the already assembled wall panel 12. A bent end section 18 of another wall panel 12 is then press fit into this space, whereby the bent end securing wall 50 is biased away from planar main panel section 16 of the already assembled wall panel 12, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16.

In this position, the outer surface 30 of the bent end section 18 is in abutting or near abutting relation with the adjacent planar main panel section 16, that is, it is at least in near abutting relation.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall structure, comprising:

a plurality of wall panels, each wall panel including:

a main wall panel, and at least two bent end sections extending at an angle from different edges of said main wall panel, each bent end section including a cut-out section at an inner wall surface thereof, each bent end section having a wall thickness, and each said cut-out section having a holding surface; and a plurality of main fastening extrusions, each fastening extrusion including:

a base section adapted to be secured to the existing wall structure, said base section including at least one base securing wall adapted to be secured by fastening devices to the existing wall structure, and two parallel, spaced apart flexible and resilient bent end securing walls extending at an angle from said base section, each said bent end securing wall including a projection at one surface thereof facing the other bent end securing wall, the two bent end securing walls having a spacing corresponding substantially to the wall thickness of two said bent end sections, each said projection has a corresponding holding surface which is engaged by said holding surface of the respective cut-out section when said projection is engaged in the respective said cut-out section to prevent escape of the respective said bent end section, and each said projection has an inclined surface which terminates in the holding surface thereof, and said at least one base securing wall of said base section includes a central base securing wall positioned between said bent end securing walls and at least one wing wall coplanar with said central base securing wall and extending outwardly of at least one said bent end securing wall, with openings in at least one of said central base securing wall and said at least one wing wall for insertion of the fastening devices therein, wherein pressing of said bent end sections into said spacing between said bent end securing walls causes said bent end securing walls to be biased away from each other until said projections engage in respective said cut-out sections to lock said bent end sections in said spacing in a manner that outer walls of said bent end sections are at least in near abutting relation with each other, and each said bent end section has a lower end with a beveled surface for engaging with said inclined surface of the respective said projection when said bent end section is pressed into said spacing between said bent end securing walls to cause the respective said bent end securing wall to be biased away from the other bent end securing wall until said projection engages in the respective said cut-out section.

2. A system for mounting wall panels to an existing wall structure, comprising:

a plurality of wall panels, each wall panel including:

a main wall panel, and at least two bent end sections extending at an angle from different edges of said main wall panel, each bent end section including a cut-out section at an inner wall surface thereof, each bent end section having a wall thickness;

a plurality of main fastening extrusions, each fastening extrusion including:

a base section adapted to be secured to the existing wall structure, and two parallel, spaced apart flexible and resilient bent end securing walls extending at an angle from said base section, each said bent end securing wall including a projection at one surface thereof facing the other bent end securing wall, the two bent end securing walls having a spacing corresponding substantially to the wall thickness of two said bent end sections, wherein pressing of said bent end sections into said spacing between said bent end securing walls causes said bent end securing walls to be biased away from each other until said projections engage in respective said cut-out sections to lock said bent end sections in said spacing in a manner that outer walls of said bent end sections are at least in near abutting relation with each other; and a plurality of corner fastening extrusions, each corner fastening extrusion including:

a corner base section adapted to be secured to one corner wall of the existing wall structure; and a flexible and resilient corner bent end securing wall extending at an angle from said base section, each said corner bent end securing wall including a projection at one surface thereof facing another adjacent corner wall of the existing wall structure when the base section is secured to said one corner wall, the corner base section having dimensions to space the flexible and resilient corner bent end securing wall from said adjacent corner wall with a spacing corresponding substantially to the wall thickness of one said bent end section, wherein pressing of a said bent end section into said spacing between said corner bent end securing wall and said adjacent corner wall causes said corner bent end securing wall to be biased away from said adjacent corner wall until said projection engages in a respective said cut-out section to lock said bent end section in said spacing in a manner that an outer wall of said bent end section is least in near abutting relation with the adjacent corner wall.

3. A system according to claim 2, wherein said base section includes at least one base securing wall adapted to be secured by fastening devices to the existing wall structure.

4. A system according to claim 3, wherein said base section includes a central base securing wall positioned between said bent end securing walls and at least one wing wall coplanar with said central base securing wall and extending outwardly of at least one said bent end securing wall, with openings in at least one of said central base securing wall and said at least one wing wall for insertion of the fastening devices therein.

5. A system according to claim 4, wherein each said cut-out section has a holding surface, and each said projection has a corresponding holding surface which is engaged by said holding surface of the respective cut-out section when said projection is engaged in the respective said cut-out section to prevent escape of the respective said bent end section.

6. A system according to claim 5, wherein each said projection has an inclined surface which terminates in the holding surface thereof, and each said cut-out has an inclined surface which terminates in the holding surface thereof.

7. A system according to claim 5, wherein:

each said projection has an inclined surface which terminates in the holding surface thereof, and each said bent end section has a lower end with a beveled surface for engaging with said inclined surface of the respective said projection when said bent end section is pressed into said spacing between said bent end securing walls to cause the respective said bent end securing wall to be biased away from the other bent end securing wall until said projection engages in the respective said cut-out section.

8. A system according to claim 2, wherein said corner base section includes at least one base securing wall adapted to be secured by fastening devices to the existing wall structure.

9. A system according to claim 8, wherein said corner base section includes a base securing wall for spacing said bent end securing wall from said adjacent corner wall and a wing wall coplanar with said base securing wall and extending outwardly of said bent end securing wall, with openings in said wing wall for insertion of the fastening devices therein.

10. A system according to claim 2, wherein each said cut-out section has a holding surface, and said projection of each corner fastening extrusion has a corresponding holding surface which is engaged by said holding surface of the respective cut-out section when said projection is engaged in the respective said cut-out to prevent escape of the respective said bent end section.

11. A system according to claim 2, wherein said projection of each corner fastening extrusion has an inclined surface which terminates in the holding surface thereof, and each said cut-out has an inclined surface which terminates in the holding surface thereof.

12. A system according to claim 10, wherein:

said projection of each corner fastening extrusion has an inclined surface which terminates in the holding surface thereof, and each said bent end section has a lower end with a beveled surface for engaging with said inclined surface of said projection of the respective corner fastening extrusion when said bent end section is pressed into said spacing between said corner bent end securing wall and said adjacent corner wall to cause the respective said bent end securing wall to be biased away from the adjacent corner wall until said projection engages in the respective said cut-out section.

* * * * *